US009248500B2

(12) United States Patent
Hammond et al.

(10) Patent No.: US 9,248,500 B2
(45) Date of Patent: Feb. 2, 2016

(54) METHOD FOR PROTECTING POWDER METALLURGY ALLOY ELEMENTS FROM OXIDATION AND/OR HYDROLIZATION DURING SINTERING

(75) Inventors: Dennis L. Hammond, Richfield, OH (US); Richard Phillips, St. Marys, PA (US)

(73) Assignee: APEX ADVANCED TECHNOLOGIES, LLC, Cleveland, OH (US)

( * ) Notice: Subject to any disclaimer, the term of this patent is extended or adjusted under 35 U.S.C. 154(b) by 1659 days.

(21) Appl. No.: 12/534,912

(22) Filed: Aug. 4, 2009

(65) Prior Publication Data

US 2010/0028194 A1 Feb. 4, 2010

Related U.S. Application Data

(60) Provisional application No. 61/085,961, filed on Aug. 4, 2008.

(51) Int. Cl.
*B22F 1/00* (2006.01)

(52) U.S. Cl.
CPC ..... *B22F 1/0062* (2013.01); *B22F 2998/10* (2013.01); *B22F 2999/00* (2013.01)

(58) Field of Classification Search
CPC . B22F 1/0062; B22F 2999/00; B22F 2998/10
USPC ..... 75/228–250, 255, 252, 253, 254
See application file for complete search history.

(56) References Cited

U.S. PATENT DOCUMENTS

| | | | | |
|---|---|---|---|---|
| 4,913,739 | A * | 4/1990 | Thummler et al. | 75/243 |
| 6,541,544 | B1 * | 4/2003 | Hart et al. | 523/410 |
| 6,679,935 | B2 | 1/2004 | Hammond | |
| 6,696,014 | B2 * | 2/2004 | Nakamura et al. | 419/11 |
| 7,183,242 | B2 | 2/2007 | Hammond | |
| 7,264,646 | B2 | 9/2007 | Hammond | |
| 2004/0050455 | A1 * | 3/2004 | Kaneko et al. | 148/105 |
| 2004/0175286 | A1 * | 9/2004 | Hammond | 419/37 |
| 2006/0034723 | A1 * | 2/2006 | Poszmik | 419/10 |
| 2007/0077164 | A1 * | 4/2007 | Hammond et al. | 419/29 |
| 2008/0025863 | A1 * | 1/2008 | Nigarura et al. | 419/11 |

OTHER PUBLICATIONS

Castro et al. "Low alloy high strength PM steels for sinterhardening," presented at PowderMet2009, Las Vegas, Nevada, 14 pages.

(Continued)

*Primary Examiner* — Roy King
*Assistant Examiner* — Vanessa Luk
(74) *Attorney, Agent, or Firm* — Rankin, Hill & Clark LLP

(57) ABSTRACT

A method for protecting powder metallurgy alloy elements from oxidation and/or hydrolyzation during sintering. The method includes (1) coating the admixed alloy elements in an inert (e.g., nitrogen) atmosphere with a hydrophobic lubricant that is capable of becoming mobile during pressing, the amount of lubricant being at least 45% of the total volume of all components to be added to the base metal powder; (2) mixing the lubricant-coated admixed alloy elements with the base metal powder to form a mixture; (3) pressing the mixture to form a pre-sintered part having a green density that is from about 95% to about 98% of a calculated pore-free density; and (4) sintering the part.

17 Claims, 10 Drawing Sheets

(56) References Cited

OTHER PUBLICATIONS

Sainz et al., "Sinterability, Hardenability and Mechanical Properties of MN-Containing PM Steels Through the Use of a Specially Designed Fe—Mn—C Master Alloy," ASM Proceedings of 2006, San Diego, California, 14 pages.

"Manganese: Making a little fine nickel go a long way," metal-powder.net, Jan. 2008, pp. 13-16.

"Finding a future for manganese by cutting costs," metal-powder.net, Jan. 2007, pp. 20 and 22-23.

* cited by examiner

METHOD FOR PROTECTING POWDER METALLURGY ALLOY ELEMENTS FROM OXIDATION AND/OR HYDROLIZATION DURING SINTERING

CROSS-REFERENCE TO RELATED APPLICATIONS

This application is a non-provisional of U.S. Application Ser. No. 61/085,961, filed Aug. 4, 2008, which is hereby incorporated by reference in its entirety.

BACKGROUND OF INVENTION

1. Field of Invention

The present invention provides a method for protecting powder metallurgy alloy elements from oxidation and/or hydrolyzation during sintering and powder metal compositions formed in accordance with the method.

2. Description of Related Art

Traditionally, copper (Cu), nickel (Ni), and molybdenum (Mo) have been used as alloy elements in powder metallurgy part-making applications. The oxides of all three elements are easily reducible during sintering. Therefore the effectiveness of such alloy elements is generally what one would expect, and the resulting parts exhibit the properties one would expect. One recent problem with the use of these alloy elements, however, is that the cost of some of them, particularly nickel and molybdenum, has risen dramatically since 2003.

Another problem is that these alloy elements are not the most effective alloy elements. There are other alloy elements such as chromium (Cr), manganese (Mn), and silicon (Si) that could produce better results if there was a way in which one could use them as alloy elements in powder metallurgy. Some of the strongest and hardest steels, and the best electromagnetic steels, include these alloy elements.

The use of elemental chromium, manganese and silicon is problematic in conventional powder metallurgy. These elements are prone to oxidize and/or hydrolyze during sintering. When pre-alloyed with iron or steel powders, they are known to produce adverse affects in powder metallurgy processing such as poor compressibility. Furthermore, when they are combined with other elements or compounds (e.g., FeCr, FeMn, FeSi), they tend to be extremely abrasive, which adversely affects die wear. Elemental chromium has been successfully pre-alloyed and used in powder metallurgy, but it has to be run in a very dry furnace (−25° F. dew point) and is known to adversely affect the compressibility of the powder. Manganese, which would likely be the most effective alloying element, has not been pre-alloyed at useful levels due to poor compressibility and has not been admixed in elemental form effectively because it oxidizes and hydrolyzes during sintering. Silicon is also subject to oxidation. Oxides formed of both manganese and silicon are stable and hard to reduce in a normal sintering cycle for powdered metal.

BRIEF SUMMARY OF THE INVENTION

In view of the foregoing, applicants have developed a method of overcoming the problems with the use of manganese and silicon as admixed alloy elements in powder metallurgy applications. Because admixed additives provide for maximum compressibility, the method of the invention focuses on resolving the problems with admix additives. The invention can also be used to protect pre-alloyed additives such as chromium. The steps of the method of the invention comprise:

(1) coating the admixed alloy elements in an inert (e.g., nitrogen) atmosphere with a hydrophobic lubricant that is capable of becoming mobile during pressing, the amount of lubricant being at least 45% of the total volume of all components to be added to the base metal powder;

(2) mixing the lubricant-coated admixed alloy elements with the base metal powder to form a mixture;

(3) pressing the mixture to form a pre-sintered part having a green density that is from about 95% to about 98% of a calculated pore-free density; and (4) sintering the part.

Powder metallurgy parts containing Mn, Cr and Si have been made successfully using the foregoing methodology. Parts produced using the foregoing methodology exhibit properties that are better than one would expect based on the amount of alloy elements present in the composition.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
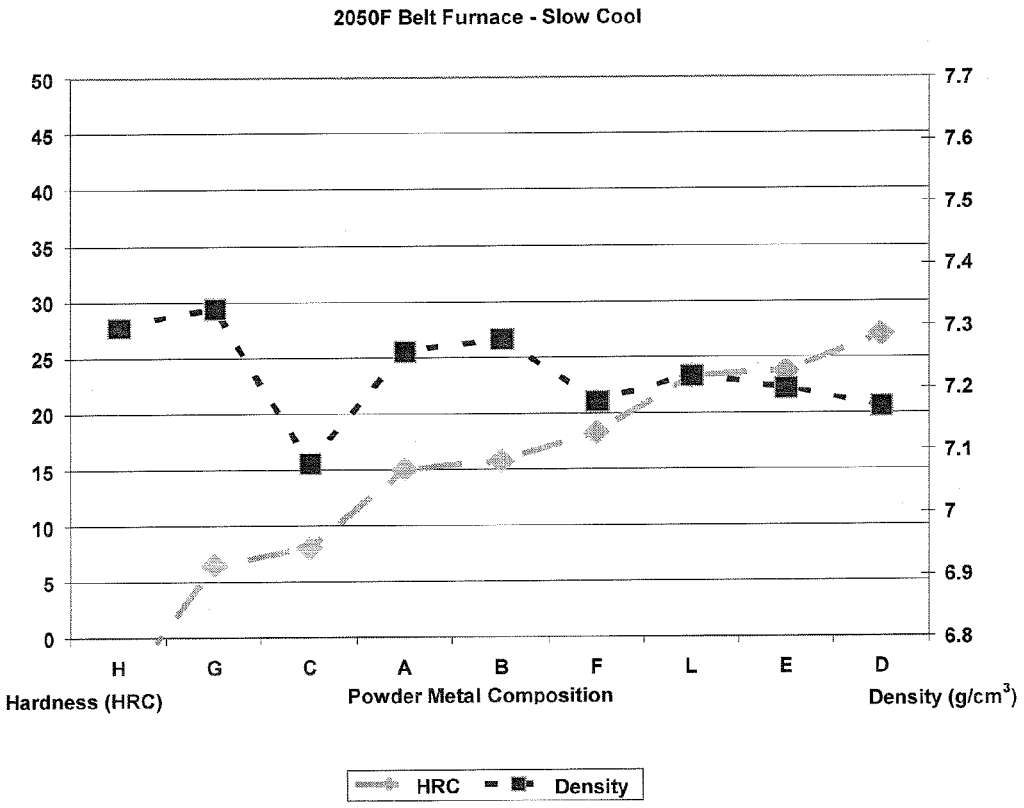
FIGS. 1-10 are graphs showing various properties of test bars formed from powder metal compositions described in Example 2.

In accordance with the invention, admixed alloy elements are coated in an inert (e.g., nitrogen) atmosphere with a hydrophobic lubricant that is capable of becoming mobile during pressing. The preferred lubricant for use in the invention is Apex SUPERLUBE PS1000B, which is commercially available from Apex Advanced Technologies, LLC of Cleveland, Ohio. At room temperature, Apex SUPERLUBE PS1000B is an off-white powder. It transforms from a solid phase material to a viscous liquid phase material during pressing (without the need for heating) and for that reason is ideally suitable for use as a lubricant in powder metallurgy. Apex SUPERLUBE PS1000B comprises, by weight, about 10% lauric acid, about 10.99% stearic acid, about 0.54% guanidine stearate, about 0.60% guanadine 2-ethyl hexonate, about 11.8% microcrystalline wax, about 17.5% polyethylene copoylmer wax, and about 48.57% of N,N'-ethylene bis-stearamide. Apex SUPERLUBE PS1000B is hydrophobic, and the combination of a hydrophobic coating and an inert atmosphere protects the admixed alloy elements from oxidation and hydrolysis during mixing, transportation and storage.

In accordance with the invention, the admixed alloy elements are coated with the lubricant in an inert atmosphere. The lubricant-coated admixed alloy elements are then mixed as a master batch with the base metal particles (e.g., pure iron or pre-alloyed steels) to form the powder metal composition. Components of the powder metal composition that do not need to be protected from oxidation and/or hydrolysis can be mixed with the lubricant-coated admixed alloy elements and base metal particles or, alternatively, can be coated with lubricant at the same time that the admixed alloy elements are coated with the lubricant and added with the master batch. The lubricant-coated alloy elements can be mixed as a master batch with standard iron or steel powders using conventional powder metallurgy blending techniques.

Coating of the alloy elements (and any other optional ingredients of the powder metal composition that may be present) can be accomplished at room temperature using medium intensity mixing and high intensity screening. The preferred lubricant, Apex SUPERLUBE PS1000B, is slightly tacky and tends to coat the alloy elements (and other optional ingredients) under such conditions. Typically, an amount of Apex SUPERLUBE PS1000B is added sufficient to provide a loading of from about 0.35% to about 0.6% by weight in the final composition (i.e., after the master batch has been mixed with the base metal particles). It is important that the amount of lubricant present in the composition be at least 45% of the total volume of all components to be added to the base metal powder. This amount of lubricant is necessary to achieve semi-hydrostatic conditions in the final compact when the pressed to the desired range. The term "semi-hydrostatic" means that substantially all of the pore volume (i.e., the space between the pressed base metal powder particles) in the pressed part is occupied by lubricant and the admixed alloy elements (and other optional components), which prevents the intake of water and other elements or compounds that could oxidize or hydrolyze the pressed part during part handling and sintering.

It will be appreciated that Apex SUPERLUBE PS1000B can advantageously be used to coat alloy elements at room temperature, and can be used in conventional non-heated powder press operations. It may also be possible to obtain the benefits provided by the invention by heating a conventional lubricant, such as an ethylene bis-stearamide wax, to a temperature near its melting point so that it can coat the alloy elements. Once the wax becomes a solid, the coated alloy elements would have to be ground to a powder, which could be mixed with a base metal powder (e.g., an iron or steel powder). In addition, it would be necessary to heat the press to cause the wax to melt and thus flow into the pores during pressing. Because this is energy intensive and difficult to obtain through parts of differing thicknesses, the use of a lubricant such as Apex SUPERLUBE 1000B is preferred.

Suitable alloy elements for use in the invention include alloying elements that are reactive, elements that are prone to hydrolysis and/or oxidation, with manganese and silicon metal being primary examples. Typically, admixed alloy elements are used in elemental form (e.g., 99% pure-sub 325 mesh). Alloy elements such as chromium and molybdenum are more conveniently pre-alloyed with the iron or steel base metal powder (the lubricant-coated admixed alloy elements, when mixed with the base metal powder, provide a beneficial protection to the pre-alloyed chromium and molybdenum). Nickel and carbon are best admixed as powders into a blend and could be added along with the master batch of lubricant-coated manganese and silicon.

Manganese is the most effective alloying element. When manganese is used as an alloy element, silicon is also preferably also used. The silicon acts as a reactive source for the vapor pressure that manganese exhibits during sintering. Without being bound to a particular theory, applicants suspect that MnSi likely forms when both elemental manganese and silicon are present during sintering. MnSi likely acts as a sintering aid (i.e., a liquid phase material) and thus reduces the swelling and loss of manganese that would normally occur in parts that are alloyed with manganese. The preferred silicon content is a percentage of stoichiometric. Higher levels of silicon cause a lowering of green density properties. The range of manganese to silicon is preferably from about 8:1 to about 2:1. The best working ratio was found to be 86% Mn and 14% Si, which provides the best compromise between green density properties and sintered properties.

Pre-sintered pressed parts are sometimes referred to in the art as green compacts. It is important that the part be pressed to a total volume of from about 95% to about 98%, and more preferably from about 96.5% to about 97.5%, of theoretical pore free density. Pore free density is defined as the density at which there is no free space in the compact. This is calculated by taking the weight percentage by the specific gravity of all components and factoring them to achieve a theoretical density of a volume having no voids. The green density of the part should be from about 95% to about 98%, and more preferably from about 96.5% to about 97.5%, of theoretical pore free density. This considers all components that are added including all additives, alloy elements, lubricant and iron powder. By pressing to this range of pore volume, all pores are filled with the mobile lubricant. This is the second key part of the protection mechanism. By having the lubricant filling all surface porosity, the elemental manganese has been effectively protected from oxidation during the wettest part of the sintering furnace (near the end) and a semi-hydrostatic condition is achieved.

Numerous sintering furnaces were used with a hydrogen/nitrogen atmosphere. All runs were successful when the described procedure was used. However, the process did not work in an endo gas furnace or when the press to total volume range (95% -98%) was not followed. In the cases of the endo gas furnace, the dew point was determined to be too high for the principles of the invention to work. This allowed water to enter in the porous part after the lubricant was burned away, which oxidized the manganese. In the case where the press range was not followed, the pores were not closed allowing oxygen or an oxygen-containing compound (e.g., water vapor) to enter into the pores of the part and oxidize the manganese metal.

The mixture can then be pressed into green compacts using standard powder metallurgy tooling and conventional pressing conditions. The compaction range is greater than 50 TSI, with each composition having its own ideal compaction range. This range is dependent on the base compressibility of the iron powder, the amount of additives used, part size and shape etc.

The pressed part can be de-bound in a nitrogen atmosphere, although this is not required if a semi-hydrostatic condition has been achieved. When a de-binding in a nitrogen atmosphere step is implemented, typically a green compact is heated up slowly to a temperature of about 325° F. The temperature is then raised and held to about 750-775° F. for about an hour. After the de-binding step, the part is sintered using conventional powder metallurgy sintering temperatures and conditions (usually vacuum or mixed hydrogen/nitrogen atmosphere). It has also been determined that a conventional de-bind works equally as well as de-binding in nitrogen as long as the press conditions are followed. The normal furnace de-bind cycle is with normal hydrogen and nitrogen mixes used in a furnace.

As noted above, the process facilitates the use of low amounts of manganese as an alloy element. Manganese (as an admixed alloy element) provides the best low-alloy steels and also responds the best to hardening. In addition, the use of lower amounts of molybdenum and other alloy elements helps reduce the cost of the material as compared to other compositions, which must use greater amounts of alloy elements in order to achieve comparable results.

The following examples are intended only to illustrate the invention and should not be construed as imposing limitations upon the claims. It should be noted that all test results referenced herein were obtained using standard test methods, including: powder molding—MPIF 60; green density—

ASTM B331; impact—ASTM E23; transverse rupture strength—ASTM B28; hardness—ASTM El 8; and size change—ASTM B610.

EXAMPLE 1

Four low-alloy steel powder metal compositions (1, 2, 3 and 4) were produced having the alloy element content shown in Table 1 (metallic constituent balance Fe).

TABLE 1

| | C | Cr | Mn | Mo | Ni | Si |
|---|---|---|---|---|---|---|
| 1 | 0.5% | — | 0.8% | — | — | 0.12% |
| 2 | 0.5% | 0.75% | 0.5% | 0.1% | — | 0.07% |
| 3 | 0.31% | 0.34% | 0.56% | 0.5% | 0.45% | 0.05% |
| 4 | 0.31% | 0.34% | 0.56% | 0.5% | 0.84% | 0.05% |

The chromium and molybdenum present in such compositions were present in standard water-atomized iron powder or pre-alloyed metal powders such as NAH Astaloy CRL, QMP Atomet 4001 and NAH ABC100.30. All of the powders would be considered to be high quality with reasonable to good compressibility. The manganese, silicon and a percentage of the carbon present in such compositions were present as elemental powders (99% pure, sub 325 mesh), which were coated with Apex SUPERLUBE PS1000B in a nitrogen atmosphere as described above and then blended with the pre-alloyed iron powders to form master batch powder metal compositions. Nickel and remaining carbon were added as admix additives.

The master batch powder metal compositions were separately molded into test parts (⅜" thick) at the press to range calculated to achieve a part having a green density that was 96.5% to about 97.5% of theoretical pore free density using an automated production press. The test bars were heated up slowly to a temperature of about 325° F., then the temperature was raised and held to about 750-775° F. for about an hour. The test bars were then sintered at 2450F in a CM box furnace with an 84% Nitrogen and 16% hydrogen with slow cooling. Table 2 shows the apparent hardness on the Rockwell B Scale (HRB) and the sintered density of test parts formed from the powders.

TABLE 2

| | Apparent HRB | Sintered Density |
|---|---|---|
| 1 | 91 | 7.41 g/cm$^3$ |
| 2 | 83 | 7.43 g/cm$^3$ |
| 3 | 86.5 | 7.40 g/cm$^3$ |
| 4 | 85 | 7.39 g/cm$^3$ |

The test parts were case hardened at 1,575° F. for 45 minutes at 0.85 C potential and then oil quenched. Test parts formed from each of the four low-alloy steels were tempered at 400° F. for 1 hour. The hardness on the Rockwell C Scale (HRC), the ultimate tensile strength, percentage elongation and impact test results are shown in Table 3.

TABLE 3

| | HRC | UTS (KSI) | Elongation | Impact (Ft-lbs) |
|---|---|---|---|---|
| 1 | 48 | 160.3 | 0.6% | 27 |
| 2 | 48 | 168.7 | 0.6% | 16 |

TABLE 3-continued

| | HRC | UTS (KSI) | Elongation | Impact (Ft-lbs) |
|---|---|---|---|---|
| 3 | 33 | 154.1 | 0.8% | 16 |
| 4 | 32 | 149.3 | 0.6% | 18 |

Test parts formed from low-alloy steels 3 and 4 were tempered at 800° F. for 1 hour. The hardness on the Rockwell C Scale (HRC), the ultimate tensile strength, percentage elongation and impact test results are shown in Table 4.

TABLE 4

| | HRC | UTS (KSI) | Elongation | Impact (Ft-lbs) |
|---|---|---|---|---|
| 3 | 26 | 136.2 | 1% | 14 |
| 4 | 25 | 137.6 | 1% | 16 |

EXAMPLE 2

Using the same methods described in Example 1, nine low-alloy steel powder metal compositions (A, B, C, D, E, F, G, H, and L) were produced having the alloy element content shown in Table 5 (metallic constituent balance Fe).

TABLE 5

| | C | Cr | Mn | Mo | Ni | Si |
|---|---|---|---|---|---|---|
| A | 0.65% | 0.5% | 0.6% | 0.29% | — | 0.07% |
| B | 0.7% | 0.75% | 0.5% | 0.1% | — | 0.07% |
| C | 0.8% | — | 0.8% | — | — | 0.12% |
| D | 0.85% | 0.75% | 0.82% | 0.27% | — | 0.11% |
| E | 0.8% | 0.5% | 0.9% | 0.29% | 0.6% | 0.12% |
| F | 0.85% | 0.5% | 0.75% | 0.07% | — | 0.11% |
| G | 0.5% | 0.75% | 0.5% | 0.1% | — | 0.07% |
| H | 0.5% | — | 0.8% | — | — | 0.12% |
| L | 0.85% | 0.74% | 0.07% | 0.27% | — | 0.05% |

The powder metal compositions were molded into test bars (⅜" thick) at the press to range calculated to achieve a part having a green density that was 96.5% to about 97.5% of theoretical pore free density using an automated production press. The green density of test bars formed from each powder metal composition is shown in Table 6.

TABLE 6

| | Green Density |
|---|---|
| A | 7.24 g/cm$^3$ |
| B | 7.26 g/cm$^3$ |
| C | 7.28 g/cm$^3$ |
| D | 7.22 g/cm$^3$ |
| E | 7.22 g/cm$^3$ |
| F | 7.26 g/cm$^3$ |
| G | 7.27 g/cm$^3$ |
| H | 7.36 g/cm$^3$ |
| L | 7.23 g/cm$^3$ |

At least one test bar made from each powder metal composition was sintered in a CM box furnace at a temperature of 2,450° F. in an atmosphere comprising 84% $N_2$ and 16% $H_2$. The test bars sintered in the box furnace were allowed to cool to ambient temperature very slowly. In the accompanying Figures, this sintering process is identified as "2450F Box Furnace—Slowest Cool".

At least one test bar made from each powder metal composition was sintered in a standard belt furnace from Sinterite at a temperature of 2,050° F. in an atmosphere comprising 84% $N_2$ and 16% $H_2$. The test bars sintered in this belt furnace were allowed to cool to ambient temperature slow (i.e., no blower was used to cool the parts). In the accompanying Figures, this sintering process is identified as "2050F Belt Furnace—Slow Cool".

At least one test bar made from each powder metal composition was sintered in a belt furnace made by Abbott at a temperature of 2,050° F. in an atmosphere comprising 84% $N_2$ and 16% $H_2$. The test bars sintered in this belt furnace were cooled using a blower at the end of the furnace (i.e., an Abbott Varicool unit). In the accompanying Figures, this sintering process is identified as "2050F Belt Furnace—Rapid Cool".

At least one test bar made from each powder metal composition was sintered in a pusher furnace made by Abbott at a temperature of 2,350° F. in an atmosphere comprising 84% $N_2$ and 16% $H_2$ The test bars sintered in the pusher furnace were cooled using a blower at the end of the furnace (This equipment is referred to as an Abbott Varicool). In the accompanying Figures, this sintering process is identified as "2350F Pusher Furnace—Rapid Cool".

Finally, at least one test bar made from each powder metal composition was sintered in a continuous vacuum furnace a C I Hayes continuous vacuum furnace at a temperature of 2,450° F. The test bars sintered in the continuous vacuum furnace were rapidly cooled using a 2 bar quench. In the accompanying Figures, this sintering process is identified as "2450F Vacuum Furnace—Rapid Cool".

FIG. 1 is a graph showing the sintered density and hardness (HRC) of the powder metal compositions using the 2050F Belt Furnace—Slow Cool sintering process.

Figure 2:
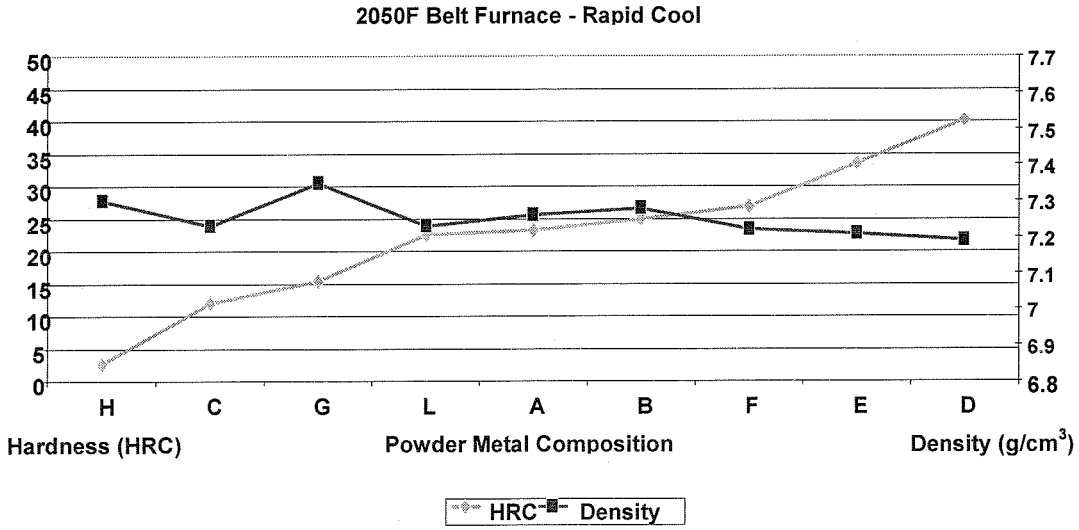

FIG. 2 is a graph showing the sintered density and hardness (HRC) of the powder metal compositions using the 2050F Belt Furnace—Rapid Cool sintering process.

Figure 3:
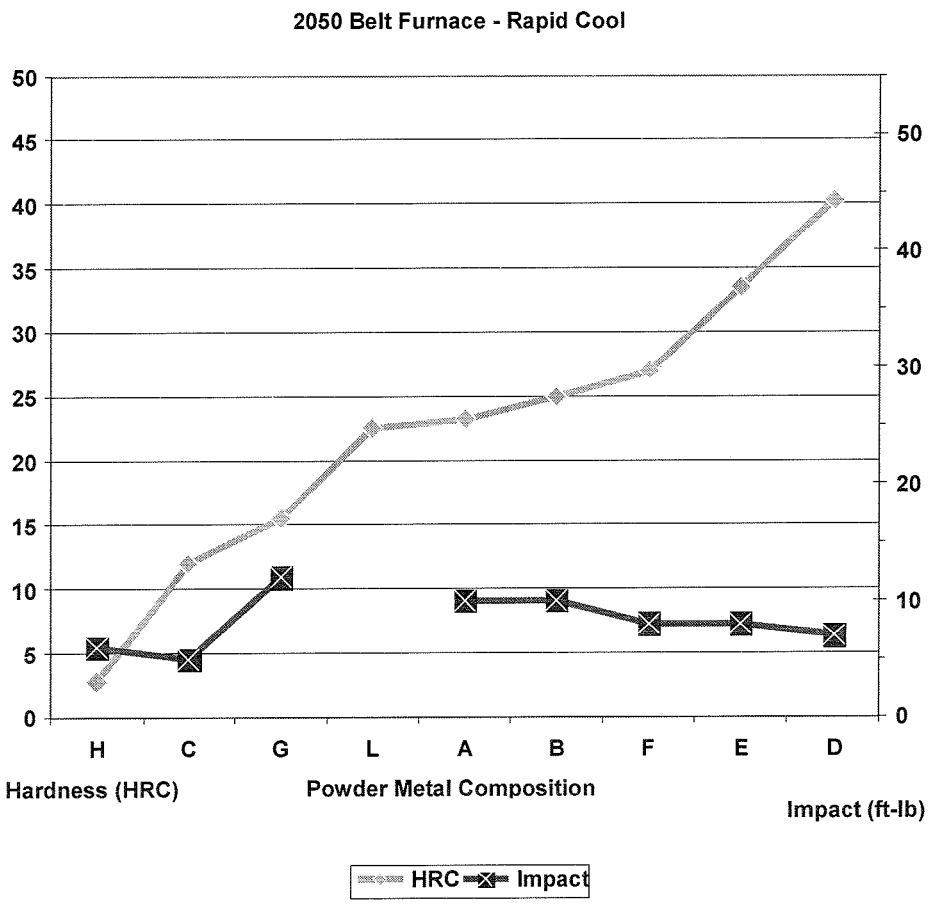

FIG. 3 is a graph showing the hardness (HRC) and impact strength of the powder metal compositions using the 2050F Belt Furnace—Rapid Cool sintering process.

Figure 4:
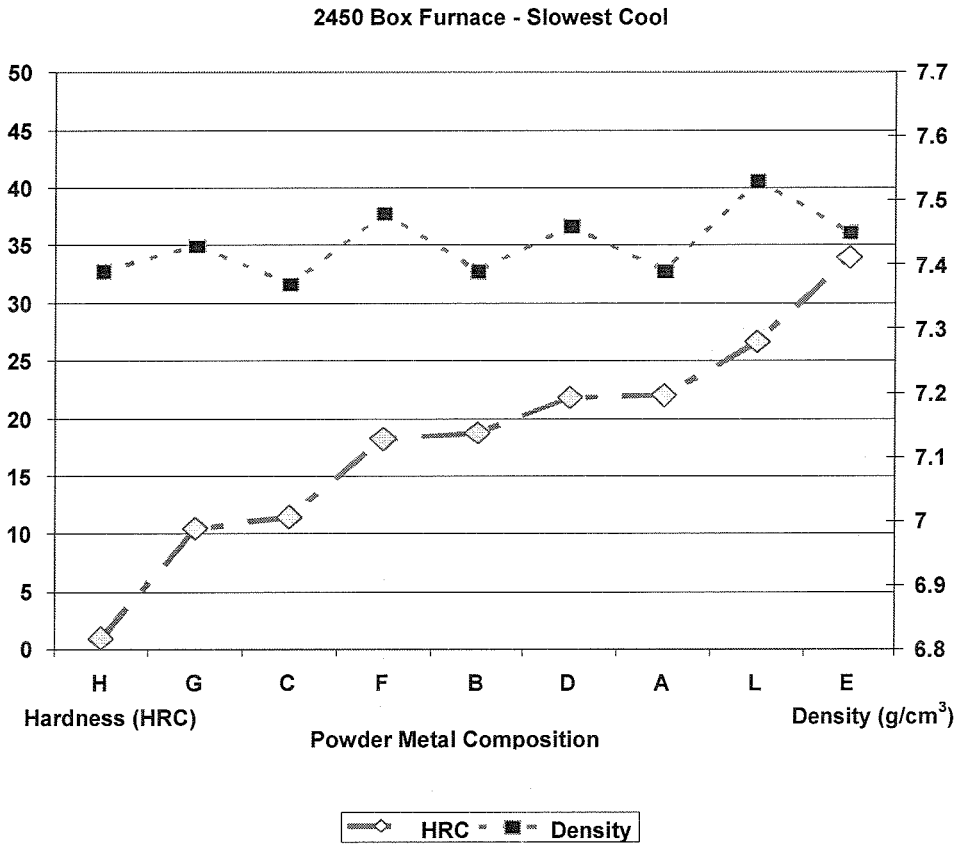

FIG. 4 is a graph showing the hardness (HRC) and density of the powder metal compositions using the 2450F Box Furnace—Slowest Cool sintering process.

Figure 5:
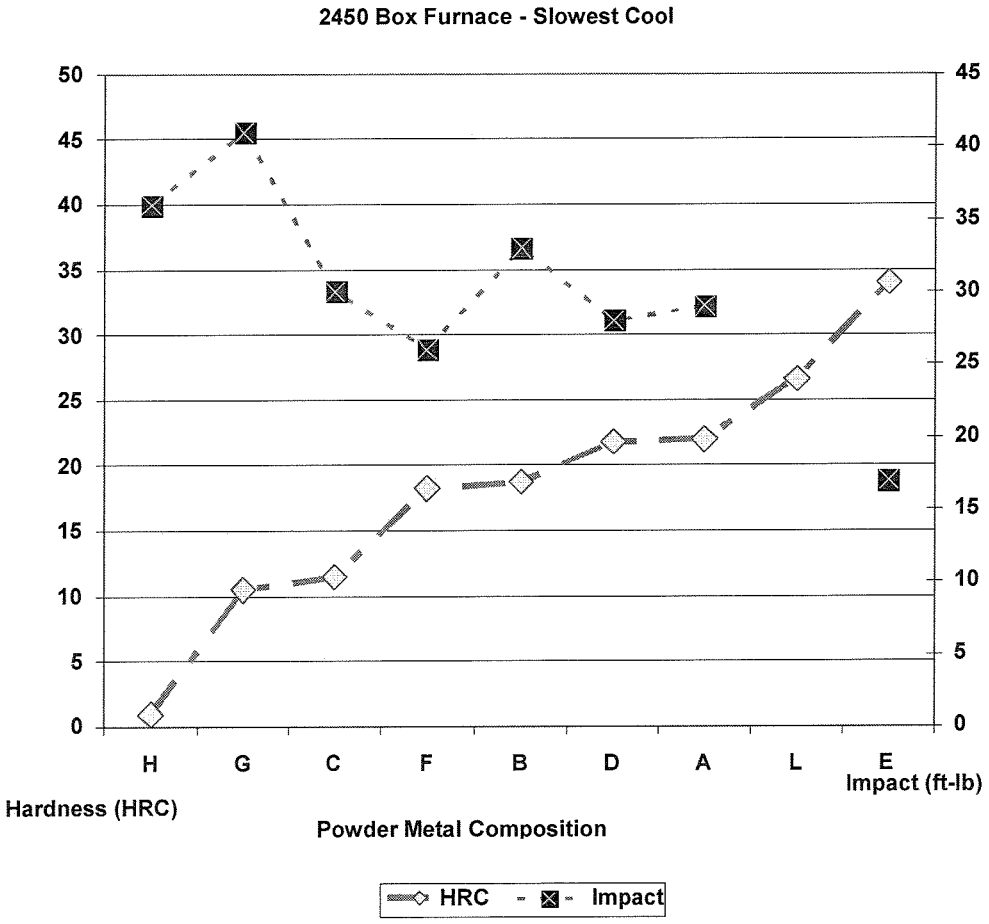

FIG. 5 is a graph showing the hardness (HRC) and impact strength of the powder metal compositions using the 2450F Box Furnace—Slowest Cool sintering process.

Figure 6:
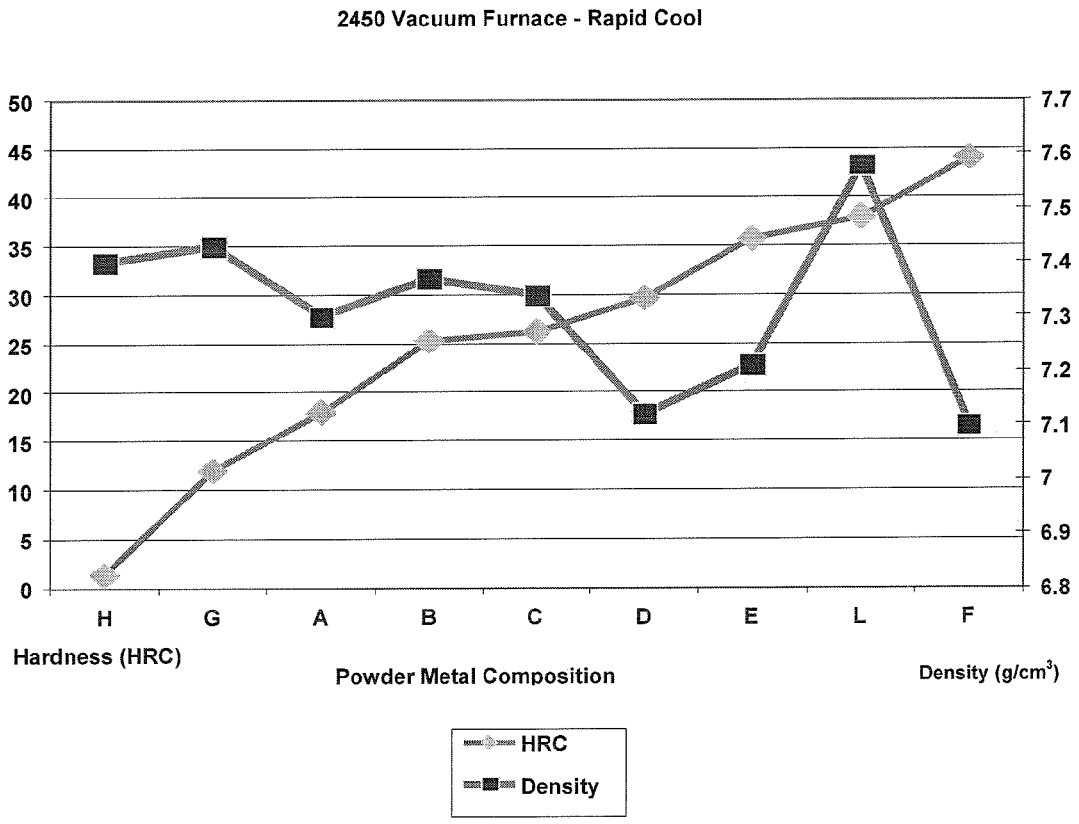

FIG. 6 is a graph showing the hardness (HRC) and density of the powder metal compositions using the 2450F Vacuum Furnace—Rapid Cool sintering process.

Figure 7:
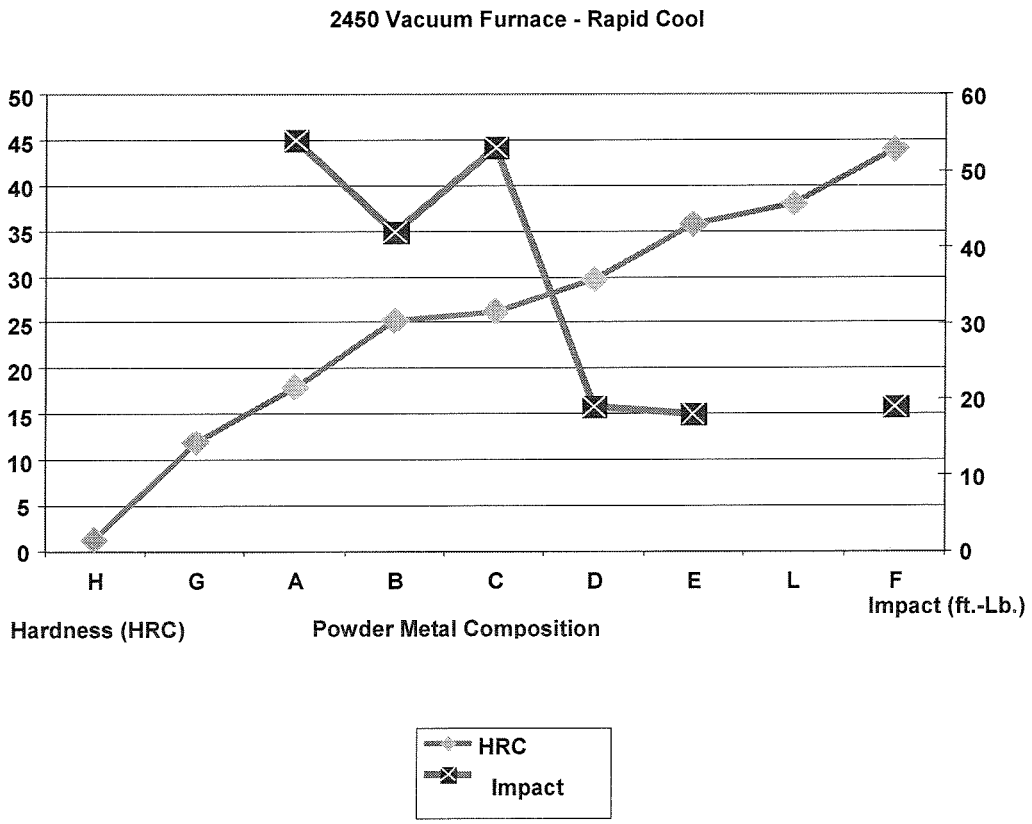

FIG. 7 is a graph showing the hardness (HRC) and impact strength of the powder metal compositions using the 2450F Vacuum Furnace—Rapid Cool sintering process.

Figure 8:
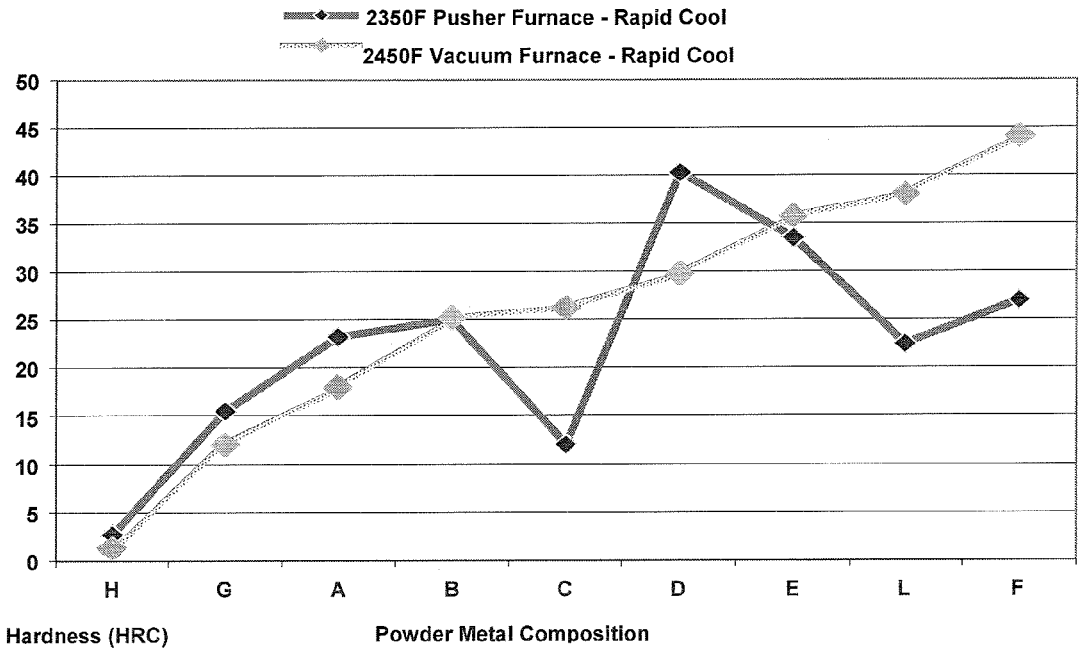

FIG. 8 is a graph showing the hardness (HRC) of the powder metal compositions using the 2350F Pusher Furnace—Rapid Cool sintering process and the 2450F Vacuum Furnace—Rapid Cool sintering process.

Figure 9:
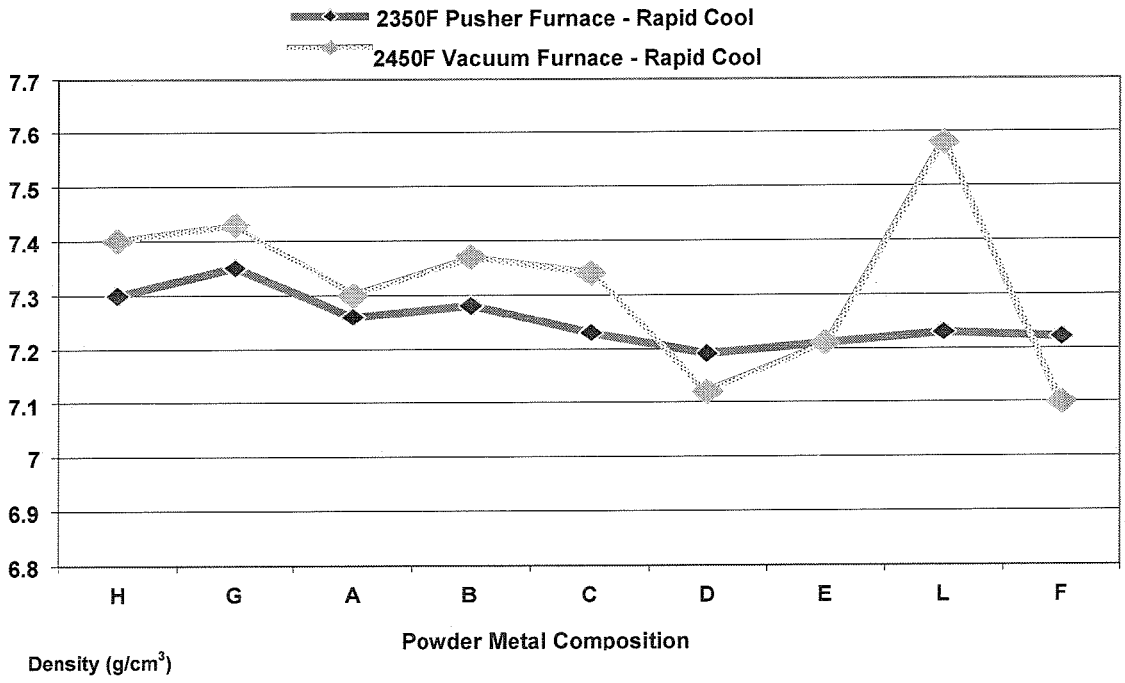

FIG. 9 is a graph showing the density of the powder metal compositions using the 2350F Pusher Furnace—Rapid Cool sintering process and the 2450F Vacuum Furnace—Rapid Cool sintering process.

Figure 10:
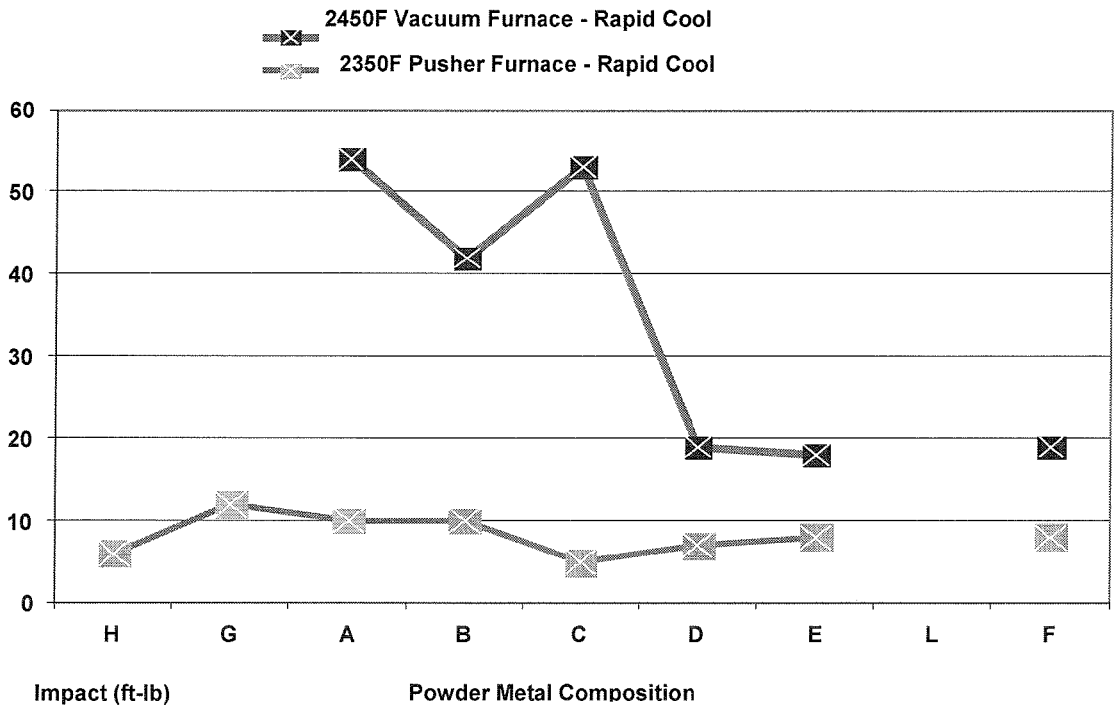

FIG. 10 is a graph showing the impact strength of the powder metal compositions using the 2350F Pusher Furnace—Rapid Cool sintering process and the 2450F Vacuum Furnace—Rapid Cool sintering process

EXAMPLE 3

Using the outlined procedures, four low-alloy steel powder metal compositions (3A, 3B, 3C and 3D) were produced having the alloy element content shown in Table 7 (metallic constituent balance Fe—the master batch included all of the manganese, silicon, lubricant and a portion of the carbon in the form of graphite, with the balance being present in the iron base metal powder).

TABLE 7

| | C | Cr | Mn | Mo | Si |
|---|---|---|---|---|---|
| 3A | 0.4% | — | 1.0% | — | 0.15% |
| 3B | 0.65% | 0.5% | 1.0% | 0.07% | 0.15% |
| 3C | 0.85% | 0.5% | 1.0% | 0.07% | 0.15% |
| 3D | 0.85% | 0.75% | 1.0% | 0.34% | 0.15% |

The powder metal compositions were molded into slugs (3.5" diameter×0.9"; weight ~2 lbs.) using a 550 ton Cincinnati press and into impact bars (⅜" thick) using a 350 ton Sinterite Best press. The range of green density of the slugs and impact bars is shown in Table 8.

TABLE 8

| | Green Density |
|---|---|
| 3A | 7.26-7.34 g/cm$^3$ |
| 3B | 7.22-7.30 g/cm$^3$ |
| 3C | 7.17-7.24 g/cm$^3$ |
| 3D | 7.17-7.24 g/cm$^3$ |

At least one test bar made from each powder metal composition was sintered in a Sinterite belt furnace with a turbo cooler at a temperature of 2,050° F. in an atmosphere comprising 90% $N_2$ and 10% $H_2$ for 30 minutes, and then allowed to cool slowly (Note: there was no de-binding in a nitrogen atmosphere for all compositions described in Example 3). In the accompanying Tables, this sintering process is identified as "2050F SC 30 MIN".

At least one test bar made from each powder metal composition was sintered in a Sinterite belt furnace with a turbo cooler at a temperature of 2,050° F. in an atmosphere comprising 90% $N_2$ and 10% $H_2$ for 60 minutes, and then allowed to cool slowly. In the accompanying Tables, this sintering process is identified as "2050F SC 60 MIN".

At least one test bar made from each powder metal composition was sintered in a Sinterite belt furnace with a turbo cooler at a temperature of 2,050° F. in an atmosphere comprising 90% $N_2$ and 10% $H_2$ for 30 minutes, and then quickly cooled. In the accompanying Tables, this sintering process is identified as "2050F FC 30 MIN".

At least one test bar made from each powder metal composition was sintered in a Sinterite belt furnace with a turbo cooler at a temperature of 2,050° F. in an atmosphere comprising 90% $N_2$ and 10% $H_2$ for 60 minutes, and then quickly cooled. In the accompanying Tables, this sintering process is identified as "2050F FC 60 MIN".

At least one test bar made from each powder metal composition was sintered in a CM batch furnace at a temperature of 2,250° F. in an atmosphere comprising 90% $N_2$ and 10% $H_2$ for 30 minutes and then allowed to cool slowly, allowing it to be fully annealed. In the accompanying Tables, this sintering process is identified as "2250F SC 30 MIN (FA)".

At least one test bar made from each powder metal composition was sintered in a CM batch furnace at a temperature of 2,350° F. in an atmosphere comprising 90% $N_2$ and 10% $H_2$ for 30 minutes and then allowed to cool slowly, allowing it to be fully annealed. In the accompanying Tables, this sintering process is identified as "2350F SC 30 MIN (FA)".

And, at least one test bar made from each powder metal composition was sintered in an Abbot pusher furnace equipped with Varicool at a temperature of 2,350° F. in an atmosphere comprising 90% $N_2$ and 10% $H_2$ for 30 minutes, and then cooled quickly. In the accompanying Tables, this sintering process is identified as "2350F FC 30 MIN".

Some of the slugs and test bars made from each powder metal composition were subjected to heat treatment for 40 minutes at 1,550° F., in a 0.85% carbon atmosphere and then tempered at 350-400° F. The slugs and test bars were then tested for sintered density, transverse rupture strength, hardness, impact and percent size change from the die. The data is reported in Tables 9-19 below.

TABLE 9

Sintered Density (g/cm$^3$)

| | 2050 FC 30 MIN | 2050 SC 30 MIN | 2050 SC 60 MIN | 2050 FC 60 MIN | 2250 SC 30 MIN (FA) | 2350 SC 30 MIN (FA) | 2350 FC 30 MIN |
|---|---|---|---|---|---|---|---|
| 3A | 7.32 | 7.34 | 7.33 | 7.35 | 7.38 | 7.4 | 7.41 |
| 3B | 7.24 | 7.25 | 7.25 | 7.27 | 7.32 | 7.33 | 7.32 |
| 3C | 7.18 | 7.16 | 7.17 | 7.21 | 7.25 | 7.26 | 7.26 |
| 3D | 7.11 | 7.15 | 7.12 | 7.14 | 7.23 | 7.25 | 7.2 |

TABLE 10

As Sintered Transverse Rupture Strength (MPa)

| | 2050 FC 30 MIN | 2050 SC 30 MIN | 2050 SC 60 MIN | 2050 FC 60 MIN | 2250 SC 30 MIN (FA) | 2350 SC 30 MIN (FA) | 2350 FC 30 MIN |
|---|---|---|---|---|---|---|---|
| 3A | 844 | 808 | 784 | 988 | 1095 | 1092 | 1087 |
| 3B | 910 | 1000 | 941 | 1141 | 1292 | 1324 | 1204 |
| 3C | 847 | 944 | 988 | 1088 | 1301 | 1339 | 1074 |
| 3D | 740 | 952 | 1001 | 1010 | 1555 | 1631 | 868 |

TABLE 11

Heat Treated Transverse Rupture Strength (MPa)

| | 2050 FC 30 MIN | 2050 SC 30 MIN | 2050 SC 60 MIN | 2050 FC 60 MIN | 2250 SC 30 MIN (FA) | 2350 SC 30 MIN (FA) | 2350 FC 30 MIN |
|---|---|---|---|---|---|---|---|
| 3A | 915 | — | 882 | — | 1424 | 1484 | 1524 |
| 3B | 873 | — | 926 | — | 1432 | 1551 | 1504 |
| 3C | 902 | — | 862 | — | 1198 | 1255 | — |
| 3D | 800 | — | 814 | — | 1192 | 1295 | — |

TABLE 12

As Sintered Hardness (Slug) HRB

| | 2050 FC 30 MIN | 2050 SC 30 MIN | 2050 SC 60 MIN | 2050 FC 60 MIN | 2250 SC 30 MIN (FA) | 2350 SC 30 MIN (FA) | 2350 FC 30 MIN |
|---|---|---|---|---|---|---|---|
| 3A | 76 | 66 | 63 | 72 | 66 | 62 | 77 |
| 3B | 93 | 84 | 80 | 90 | 81 | 83 | 97 |
| 3C | 96 | 89 | 92 | 93 | 85 | 86 | 100 |
| 3D | 105 | 96 | 97 | 107 | 91 | 92 | 111 |

TABLE 13

Heat Treated Hardness (Slug) HRC

| | 2050 FC 30 MIN | 2050 SC 30 MIN | 2050 SC 60 MIN | 2050 FC 60 MIN | 2250 SC 30 MIN (FA) | 2350 SC 30 MIN (FA) | 2350 FC 30 MIN |
|---|---|---|---|---|---|---|---|
| 3A | — | — | — | — | 37 | 33 | — |
| 3B | — | — | — | — | 46 | 42 | — |
| 3C | — | — | — | — | 48 | 48 | — |
| 3D | — | — | — | — | 51 | 49 | — |

TABLE 14

| As Sintered Hardness (Impact Bar) HRB | | | | | | | |
|---|---|---|---|---|---|---|---|
| | 2050 FC 30 MIN | 2050 SC 30 MIN | 2050 SC 60 MIN | 2050 FC 60 MIN | 2250 SC 30 MIN (FA) | 2350 SC 30 MIN (FA) | 2350 FC 30 MIN |
| 3A | 82 | 77 | 78 | 73 | 69 | 65 | 78 |
| 3B | 97 | 96 | 96 | 88 | 90 | 84 | 100 |
| 3C | 101 | 97 | 99 | 99 | 90 | 90 | 107 |
| 3D | 114 | 102 | 107 | 100 | 97 | 97 | 117 |

TABLE 15

| Heat Treated Hardness (Impact Bar) HRC | | | | | | | |
|---|---|---|---|---|---|---|---|
| | 2050 FC 30 MIN | 2050 SC 30 MIN | 2050 SC 60 MIN | 2050 FC 60 MIN | 2250 SC 30 MIN (FA) | 2350 SC 30 MIN (FA) | 2350 FC 30 MIN |
| 3A | 47 | 41 | 42 | 42 | 39 | 35 | 43 |
| 3B | 49 | 48 | 48 | 49 | 49 | 48 | 47 |
| 3C | 49 | 48 | 47 | 49 | 49 | 48 | — |
| 3D | 48 | 47 | 47 | 48 | 50 | 48 | — |

TABLE 16

| As Sintered Impact (ft-lbs) | | | | | | | |
|---|---|---|---|---|---|---|---|
| | 2050 FC 30 MIN | 2050 SC 30 MIN | 2050 SC 60 MIN | 2050 FC 60 MIN | 2250 SC 30 MIN (FA) | 2350 SC 30 MIN (FA) | 2350 FC 30 MIN |
| 3A | 12 | 16 | 15 | 21 | 63 | 72 | 31 |
| 3B | 7 | 10 | 11 | 13 | 34 | 43 | 21 |
| 3C | 6 | 7 | 10 | 13 | 24 | 29 | 15 |
| 3D | 5 | 7 | 8 | 7 | 25 | 31 | 8 |

TABLE 17

| Heat Treated Impact (ft-lbs) | | | | | | | |
|---|---|---|---|---|---|---|---|
| | 2050 FC 30 MIN | 2050 SC 30 MIN | 2050 SC 60 MIN | 2050 FC 60 MIN | 2250 SC 30 MIN (FA) | 2350 SC 30 MIN (FA) | 2350 FC 30 MIN |
| 3A | 6 | 7 | 5 | 6 | 8 | 11 | 8 |
| 3B | 5 | 5 | 5 | 6 | 8 | 12 | 10 |
| 3C | 5 | 5 | 5 | 6 | 8 | 8 | — |
| 3D | 5 | 5 | 6 | 6 | 8 | 10 | — |

TABLE 18

| Percent Size Change from Die (As Sintered) | | | | | | | |
|---|---|---|---|---|---|---|---|
| | 2050 FC 30 MIN | 2050 SC 30 MIN | 2050 SC 60 MIN | 2050 FC 60 MIN | 2250 SC 30 MIN (FA) | 2350 SC 30 MIN (FA) | 2350 FC 30 MIN |
| 3A | 0.30% | 0.32% | 0.29% | 0.20% | 0.20% | 0.15% | 0.17% |
| 3B | 0.41% | 0.34% | 0.29% | 0.29% | 0.14% | 0.02% | 0.10% |
| 3C | 0.44% | 0.42% | 0.39% | 0.30% | 0.14% | 0.02% | 0.10% |
| 3D | 0.41% | 0.39% | 0.32% | 0.30% | 0.08% | −0.07% | −0.05% |

TABLE 19

| | Percent Size Change from Die (Heat Treated) | | | | | | |
|---|---|---|---|---|---|---|---|
| | 2050 FC 30 MIN | 2050 SC 30 MIN | 2050 SC 60 MIN | 2050 FC 60 MIN | 2250 SC 30 MIN (FA) | 2350 SC 30 MIN (FA) | 2350 FC 30 MIN |
| 3A | 0.44% | 0.42% | 0.39% | 0.32% | 0.20% | 0.15% | 0.17% |
| 3B | 0.49% | 0.47% | 0.56% | 0.36% | 0.14% | 0.02% | 0.10% |
| 3C | 0.56% | 0.44% | 0.56% | 0.44% | 0.14% | 0.02% | 0.10% |
| 3D | 0.44% | 0.34% | 0.47% | 0.30% | 0.08% | −0.07% | −0.05% |

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A method for the powder metallurgical production of a sintered part, the method comprising:

providing a dry iron-containing base metal powder;

providing one or more dry powder metallurgy alloy elements selected from the group consisting of elemental manganese and elemental silicon;

coating the one or more powder metallurgy alloy elements in an inert atmosphere with a hydrophobic lubricant that is capable of transforming from a solid phase material to a viscous liquid phase material during pressing in a non-heated press, the amount of lubricant being at least 45% of the total volume of all components to be added to the base metal powder;

mixing the lubricant-coated powder metallurgy alloy elements with the base metal powder to form a mixture;

pressing the mixture to form a pre-sintered part having a green density that is from about 95% to about 98% of a theoretical pore-free density; and sintering the part.

2. The method according to claim 1 wherein the pre-sintered part is pressed such that the green density is 96.5-97.5% of theoretical pore free density.

3. The method according to claim 1 wherein the mixture further comprises one or more selected from the group consisting of carbon powder and nickel powder.

4. The method according to claim 1 wherein the one or more lubricant-coated powder metallurgy alloy elements mixed with the base metal powder include both elemental manganese and elemental silicon.

5. The method according to claim 4 wherein the weight ratio of elemental manganese to elemental silicon is from about 8:1 to about 2:1.

6. The method according to claim 4 wherein the mixture further comprises one or more selected from the group consisting of carbon powder and nickel powder.

7. The method according to claim 1 further comprising de-binding the pre-sintered part in a nitrogen atmosphere prior to the sintering step.

8. The method according to claim 1 wherein the coating step comprises contacting the one or more powder metallurgy alloy elements and the lubricant together in a medium intensity mixer to form a pre-mixture and subjecting the pre-mixture to high intensity screening.

9. The method according to claim 1 wherein the inert atmosphere is nitrogen.

10. The method according to claim 1 wherein the base metal particles are pre-alloyed with one or more selected from the group consisting of chromium and molybdenum.

11. The method according to claim 1 wherein the mixture comprises lubricant-coated elemental manganese particles, the elemental manganese particles comprise about 1% by weight of the mixture, and the mixture further comprises about 0.4% by weight of carbon powder.

12. The method according to claim 1, wherein the mixture comprises lubricant-coated elemental manganese particles, the elemental manganese particles comprise about 1% by weight of the mixture, the mixture comprises about 0.5% by weight of chromium and about 0.07% by weight of molybdenum, and the mixture further comprises about 0.65% by weight of carbon powder.

13. The method according to claim 12 wherein the chromium and the molybdenum are pre-alloyed with the iron-containing base metal particles.

14. The method according to claim 1, wherein the mixture comprises lubricant-coated elemental manganese particles, the elemental manganese particles comprise about 1% by weight of the mixture, the mixture comprises about 0.5% by weight of chromium and about 0.07% by weight of molybdenum, and the mixture further comprises about 0.85% by weight of carbon powder.

15. The method according to claim 14 wherein the chromium and the molybdenum are pre-alloyed with the iron-containing base metal particles.

16. The method according to claim 1, wherein the mixture comprises lubricant-coated elemental manganese particles, the elemental manganese particles comprise about 1% by weight of the mixture, and the mixture comprises about 0.75% by weight of chromium and about 0.34% by weight of molybdenum, and the mixture further comprises about 0.85% by weight of carbon powder.

17. The method according to claim 16 wherein the chromium and the molybdenum are pre-alloyed with the iron-containing base metal particles.

* * * * *